United States Patent [19]

Breckenfeld et al.

[11] Patent Number: 4,569,415

[45] Date of Patent: Feb. 11, 1986

[54] AIR SILENCER FOR AN INTERNAL COMBUSTION ENGINE

[75] Inventors: Paul W. Breckenfeld, Winthrop Harbor; George L. Broughton; James E. Macier, both of Waukegan; David C. Calamia, Grays Lake, all of Ill.

[73] Assignee: Outboard Marine Corporation, Waukegan, Ill.

[21] Appl. No.: 640,024

[22] Filed: Aug. 9, 1984

[51] Int. Cl.[4] ..... F02M 35/00

[52] U.S. Cl. ..... 181/229; 123/198 C

[58] Field of Search ..... 181/229, 233, 235, 240, 181/243, 244, 259–261; 123/195 C, 198 C, 198 E

[56] References Cited

U.S. PATENT DOCUMENTS

| | | | |
|---|---|---|---|
| 2,865,467 | 12/1958 | McMichael | 181/229 X |
| 3,810,526 | 5/1974 | Kawasaki | 181/229 |
| 3,835,956 | 9/1974 | Kishira | 181/229 |
| 4,458,641 | 7/1984 | Wickramasuriya | 123/198 C X |
| 4,479,463 | 10/1984 | Curley et al. | 123/195 C |

*Primary Examiner*—Benjamin R. Fuller

*Attorney, Agent, or Firm*—Michael, Best & Friedrich

[57] ABSTRACT

Silencer apparatus for an internal combustion engine including an intake manifold, the apparatus comprising an air silencer having a lower end including a sump, and a conduit extending upwardly from the sump to the intake manifold for purging the sump of fluid only when the engine is operating.

15 Claims, 7 Drawing Figures

AIR SILENCER FOR AN INTERNAL COMBUSTION ENGINE

RELATED APPLICATION

Attention is directed to the Breckenfeld, et al. U.S. patent application filed concurrently herewith and entitled "Air Silencer for an Internal Combustion Engine."

BACKGROUND OF THE INVENTION

This invention relates to internal combustion engines and, more particularly, to air silencer apparatus for internal combustion engines.

Prior air silencer apparatus include means for draining the air silencer cavity of fluid such as water and fuel. These prior means have used gravity or a combination of gravity and a vacuum to transfer the fluid from the air silencer cavity to the crankcase (such as draining the bottom of the air silencer cavity downwardly into the crankcase). With such means, fluid is introduced into the crankcase or other engine cavities while the engine is not operating. In such a case, the fluid is not immediately purged from the engine, and the result is a deposit of fluid which can lead to corrosion of internal engine components or initial starting difficulties.

Attention is directed to the following U.S. patents which disclose air silencer apparatus:

Kawasaki U.S. Pat. No. 3,810,526 issued May 14, 1974; and

Kishira U.S. Pat. No. 3,835,956, issed Sept. 17, 1974.

SUMMARY OF THE INVENTION

The invention provides silencer apparatus for an internal combustion engine, the apparatus comprising an air silencer having a lower end including a sump, and means for purging the sump of fluid only when the engine is operating.

In one embodiment, the means for purging the sump includes means for fluid communication between the sump and a vacuum source created in response to engine operation, the communication means being operable to effect fluid flow from the sump to the vacuum source only in response to a vacuum condition in the vacuum source.

In one embodiment, the communication means includes conduit means extending upwardly from the sump to the vacuum source.

In one embodiment, the engine includes an intake manifold, and the vacuum source is the intake manifold.

In one embodiment, the conduit means includes a metering orifice for regulating the flow of fluid from the sump to the intake manifold.

In another embodiment, the internal combustion engine includes a crankcase and the vacuum source is the crankcase.

In one embodiment, the conduit means includes valve means for preventing flow from the crankcase to the sump while permitting flow from the sump to the crankcase.

The invention also provides an engine apparatus comprising an internal combustion engine, an air silencer having a lower end including a sump, and means for purging the sump of fluid only in response to engine operation.

A principal feature of the invention is the provision of an air silencer apparatus having a sump for collecting fluid such as water and fuel, and means for purging the sump of fluid only when the engine is operating. This avoids deposits of fluid in engine cavities which can lead to corrosion of engine components or starting difficulties.

Other features and advantages of the invention will become apparent to those skilled in the art upon review of the following detailed description, claims, and drawings.

DESCRIPTION OF THE DRAWINGS

FIG. 4 is a cross sectional view taken along line 5—5 in FIG. 4.

Figure 1:
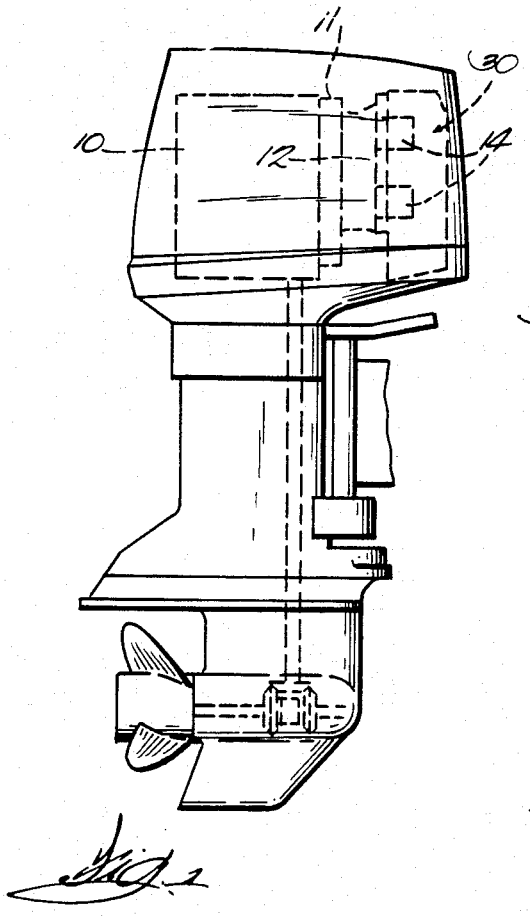
FIG. 1 is a schematic view of an air silencer apparatus embodying the invention and mounted on an internal combustion engine in an outboard motor.

Before explaining one embodiment of the invention in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is an internal combustion engine 10 including a crankcase 11, an intake manifold 12 attached to the crankcase 11, and carburetors 14 mounted on the intake manifold 12. In the illustrated construction, the carburetors 14 are made of plastic, and the engine 10 includes four carburetors 14, although the invention is applicable to engines including either more or fewer carburetors.

It should be noted that while the illustrated engine is a two-stroke engine wherein the intake manifold is attached to the crankcase, the invention could also be used, with appropriate modifications, with a four-stroke engine.

Figure 3:
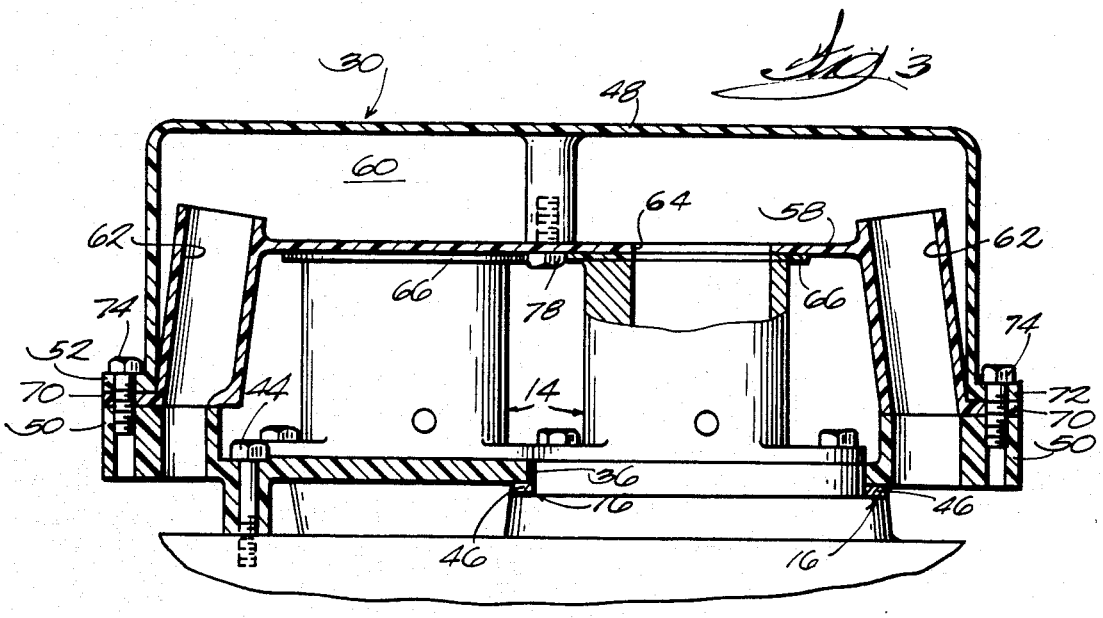
FIG. 3 is a cross sectional view taken along line 3—3 in FIG. 2.

Air needed for combustion passes from the carburetors 14 to the combustion chambers (not shown), with each carburetor 14 providing a fuel-air mixture for one of the combustion chambers. In order to provide for communication between the carburetors 14 and the respective combustion chambers, non-aligned openings in the crankcase 11 communicating with the combustion chambers determine the locations of openings in the intake manifold 12. The openings in the intake manifold 12 in turn determine the locations of the carburetors 14 provided for each of the combustion chambers. In the illustrated construction, the intake manifold 12 includes four shoulders 16 surrounding the openings over which the carburetors 14 are mounted, as best seen in FIG. 3. In the preferred embodiment, the carburetors 14 are side draft carburetors.

Figure 2:
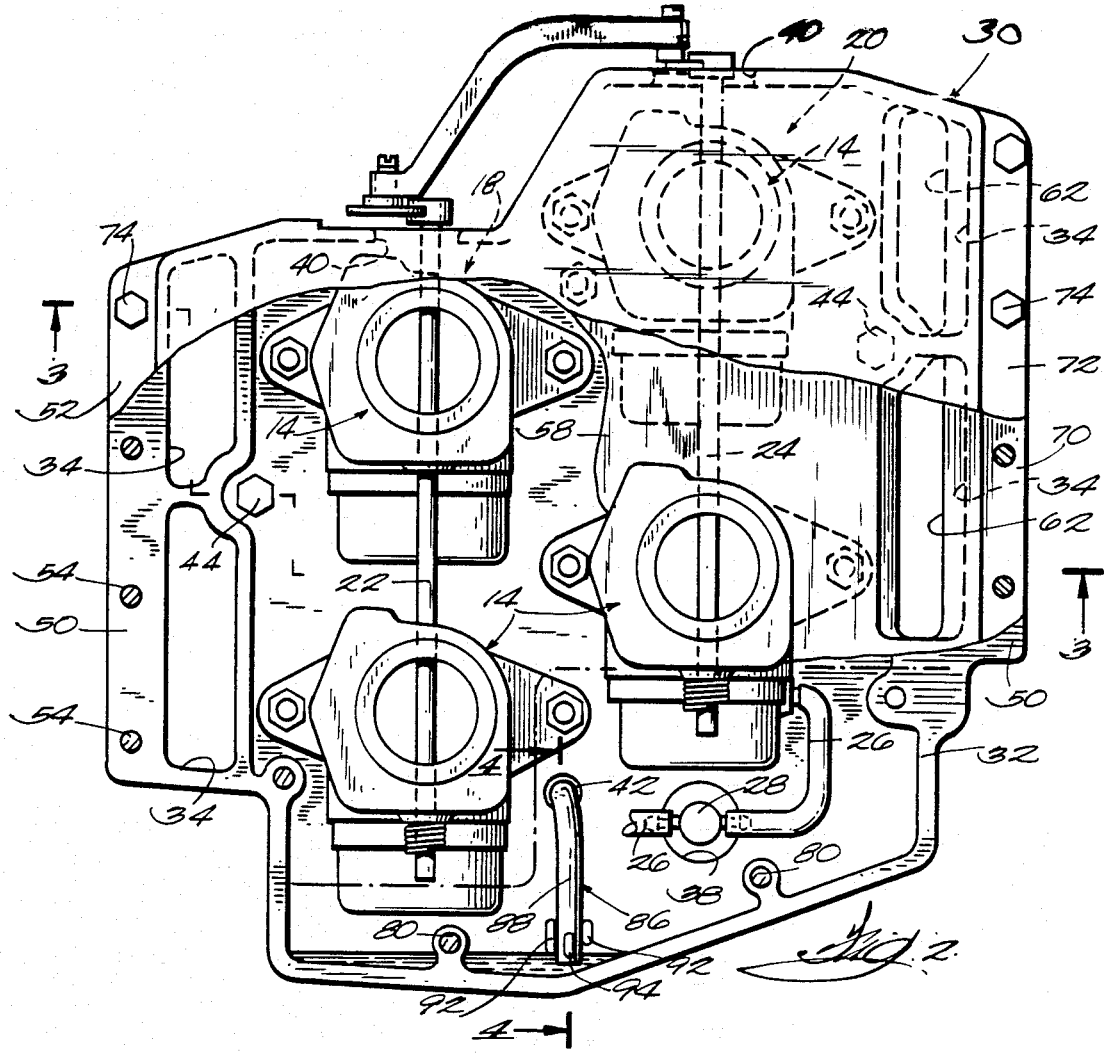
FIG. 2 is a front view of the air silencer apparatus with the baffle member and cover member being partially cut away.

As illustrated in FIG. 2, the carburetors 14 form a first set 18 of two carburetors 14 and a second set 20 of two carburetors 14. A single throttle shaft 22 controls the throttle valves of the first set 18 of carburetors 14, and a single throttle shaft 24 controls the throttle valves of the second set 20 of carburetors 14. Each carburetor 14 has an associated fuel hose 26 (only one is shown completely) that carries fuel to the carburetor 14, and the fuel hoses 26 are connected to a fuel manifold 28 which is connected to a source of fuel (not shown).

The engine 10 also includes an air silencer 30 comprising a support member or base member 32, and means for mounting the support member or base member 32 on the engine 10 independently of the carburetors 14. In other words, the air silencer 30 is mounted on the engine 10 without physical support from the carburetors 14. This provides the advantages of avoiding stress on the carburetors, allowing tolerance build-up in the carburetor area, and facilitating the use of plastic carburetors.

While various suitable means can be employed for mounting the base member 32 on the engine 10 independently of the carburetors, in the illustrated construction, such means includes means for mounting the base member 32 on the intake manifold 12 independently of the carburetors 14. In the preferred embodiment (see FIGS. 2 and 3), the means for mounting the base member 32 on the intake manifold 12 includes a plurality of bolts 44 extending through apertures in the base member 32 and being threadedly engaged with the intake manifold 12.

In the preferred embodiment, as best seen in FIG. 2, the support member or base member 32 includes a plurality of openings 34 to the atmosphere. While these openings 34 are shown as elongated openings, they can be shaped otherwise, such as being circular. The base member 32 also includes four openings 36 (see FIG. 3) adapted to have the carburetors 14 extend therethrough, and a fuel manifold opening 38 through which the fuel manifold 28 extends. The base member 32 also includes a pair of openings 40 for the throttle shafts, and a drain opening 42 which will be explained hereinafter.

The air silencer 30 also comprises gaskets 46 positioned between the shoulders 16 on the intake manifold 12 and the base member 32 and around the openings 36 in the base member 32.

The air silencer 30 further comprises a cover member 48 removably mounted on the base member 32. The cover member 48 and the base member 32 are essentially four-sided and have substantially identically shaped peripheries. On opposite sides of the base member 32 are flanges 50 that line up with complementary flanges 52 on opposite sides of the cover member 48, as best seen in FIG. 3. Each flange 50 on the base member 32 includes four bolt holes 54 that line up with complementary bolt holes 56 on the flanges 52 of the cover member 48. The manner in which the cover member 48 is secured to the base member 32 will be described hereinafter.

Figure 7:
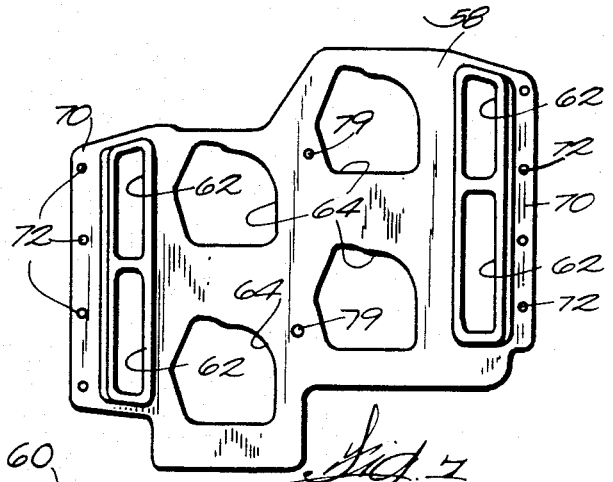
FIG. 7 is a front view of the baffle member of the air silencer apparatus.

The air silencer 30 further comprises a baffle member 58 mounted between the cover member 48 and the base member 32 to form a silencing chamber 60 between the cover member 48 and the baffle member 58. The baffle member 58 includes silencer tubes 62 communicating between the elongated openings 34 in the base member 32 and the silencing chamber 60, and four openings 64 (see FIGS. 3 and 7) communicating with the carburetor intakes. Four gaskets 66 (see FIG. 3) are positioned between the ends of the carburetors 14 and the baffle member 58 and around the openings 64 in the baffle member 58. The gaskets 66 are soft gaskets which allow for tolerance build-up between the parts.

Figure 6:
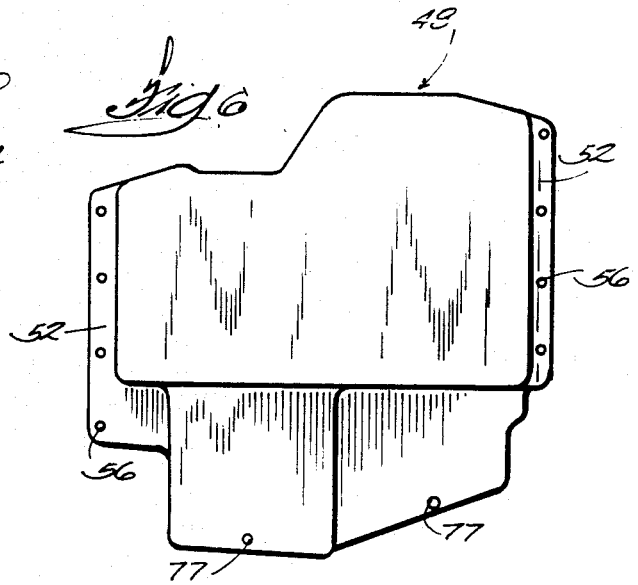
FIG. 6 is a front view of the cover member of the air silencer apparatus.

The baffle member 58 has a periphery that is substantially identical to the peripheries of the base member 32 and cover member 48 along the sides and top (as viewed in FIG. 2), but the baffle member 58 does not extend as fat down (as viewed in FIG. 2) as the base member 32 and cover member 48. The bottom edge of the baffle member 58 abuts a flange 68 (see FIG. 4) extending inwardly from the cover member 48 to substantially complete or seal the silencing chamber 60 formed between the baffle member 58 and the cover member 48. The opposite sides of the baffle member 58 include flanges 70 (see FIGS. 3 and 7) that extend between the flanges 50 and 52 of the base member 32 and cover member 48, and that include bolt holes 72 that line up with the bolt holes 54 and 56 in the base member 32 and cover member 48. The cover member 48 and baffle member 58 are removably mounted on the base member 32 by bolts 74 extending through the bolt holes 52 and 72 in the cover member 32 and baffle member 58 and threadedly engaged in the bolt holes 50 in the base member 32. Furthermore, the cover member 48 is connected to the base member 32 by bolts extending through bolt holes 77 (see FIG. 6) in the cover member 48 and threadedly engaged in complementary bolt holes 80 (see FIG. 2) in the base member 32, and the cover member 48 is connected to the baffle member 58 by bolts 78 (see FIG. 3) extending through bolts holes 79 (see FIG. 7) in the baffle member 58 and threadedly engaged in the cover member 48.

In the preferred embodiment, the baffle member 58 is made of plastic, and the manner in which the baffle member 58 is mounted between the base member 32 and cover member 48 allows easy replacement or substitution of new baffle members. Therefore, the silencing chamber 60 and/or silencing tubes 62 can be inexpensively changed to keep up with silencing technology.

Figure 4:
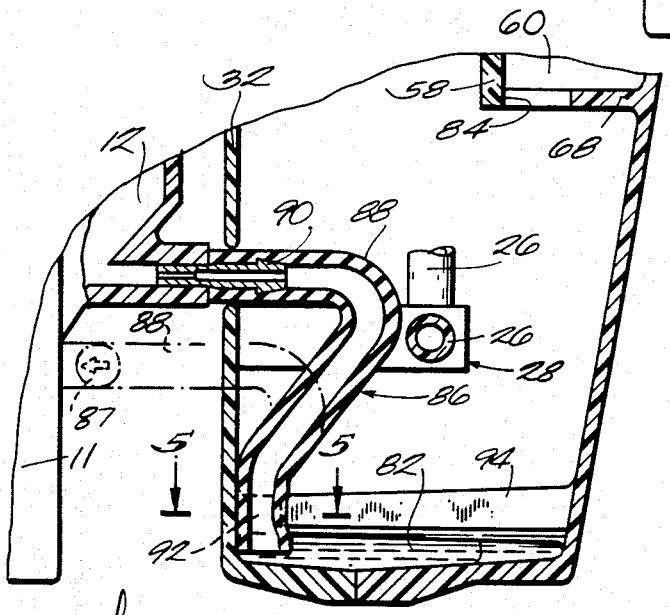
FIG. 4 is a cross sectional view taken along line 4—4 in FIG. 2.

Beneath the lower edge of the baffle member 58, as illustrated in FIG. 4, the cover member 48 and base member 32 form a sump 82 for collecting water, oil, and fuel. Drain holes 84 (see FIG. 4) are provided in the flange 68 in order to allow fluid in the silencing chamber 60 to drain into the sump 82.

The air silencer 30 further comprises means for purging the sump 82 of fluid only when the engine 10 is operating, or only in response to engine operation. While various suitable means can be employed for this purpose, in the preferred embodiment, such means includes means for fluid communication between the sump 82 and a vacuum source created in response to engine operation, the communication means being operable to effect fluid flow from the sump 82 to the vacuum source only in response to a vacuum condition in the vacuum source. In the preferred embodiment, the communication means includes conduit means 86 extending upwardly from the sump 82 to the vacuum source.

In an alternative embodiment not shown, in the drawings, the communication means can be a conduit extending from the sump 82 to the vacuum source, and a check valve permitting flow through the conduit from the sump 82 to the vacuum source only in response to a vacuum condition in the vacuum source. In this alternative embodiment, the conduit need not extend upwardly to the vacuum source.

In the preferred embodiment, the vacuum source is the intake manifold 12, and the conduit means 86 communicates with the intake manifold 12 upstream of the reed valves (not shown) where the pressure does not exceed atmospheric pressure. In an alternative embodiment shown in dotted lines in FIG. 4, the vacuum source is the crankcase 11, and the conduit means 86 includes valve means 87 for preventing flow from the crankcase 11 to the sump 82 while permitting flow from the sump 82 to the crankcase 11.

Figure 5:
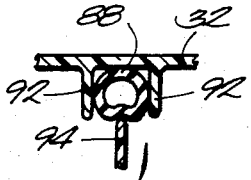

The conduit means 86 is best illustrated in FIGS. 2, 4, and 5. In the illustrated construction, the conduit means 86 includes a rubber hose 88 extending upwardly from the sump 82 to the intake manifold 12. Because the hose 88 extends upwardly, the fluid in the sump 82 flows into the intake manifold 12 only when a vacuum exists in the intake manifold 12. The suction force of the vacuum must overcome the head created by the hose 88.

More particularly, the rubber hose 88 includes a lower end opening into the sump 82, and an upper end extending through the drain hole 42 in the base member 32 and being connected to a nipple 90 extending from the intake manifold 12. The nipple 90 includes a metering orifice regulating flow through the nipple 90 so that the volume of air and fluid drawn into the intake manifold 12 through the hose 88 is insignificant in relationship to engine running characteristics. The lower end of the hose 88 is held in place by a pair of flanges 92 extending outwardly from the inner surface of the base member 32 and positioned on opposite sides of the hose 88, as best seen in FIG. 5, and by a flange 94 extending inwardly from the cover member 48 and engaging the hose 88 to hold it between the flanges 92 extending from the base member 32, as best seen in FIGS. 4 and 5.

The air silencer 30 functions as follows. Air for the carburetor intakes is drawn into the air silencer 30 through the silencer tubes 62 which communicate between the openings 34 in the base member 32 and the silencing chamber 60. This air then flows through the silencing chamber 60 to the carburetor intakes. For reasons well understood by those skilled in the art, drawing the air through the silencer tubes 62 and the silencing chamber 60 reduces engine noise.

The silencing chamber 60 also serves to catch fluid such as fuel and oil that is blown back out of the carburetor intakes. This fluid drains through the drain holes 84 in the cover flange 68 into the sump 82, from where it is sucked through the hose 88 into the intake manifold 12. Because a vacuum is present in the intake manifold 12 only when the engine 10 is operating, the fluid in the sump 82 is sucked into the intake manifold 12 only when the engine 10 is operating. Once in the intake manifold 12 of the running engine 10, the fluid is purged through the engine 10 along with the normal intake mixture.

Various features of the invention are set forth in the following claims.

We claim:

1. Silencer apparatus for an internal combustion engine including a carburetor having an air intake, said apparatus comprising an air silencer communicating with the air intake and having a lower end including a sump in which fluid can accumulate, and means connected to the engine and extending to said sump for purging said sump of fluid only in response to engine operation.

2. Silencer apparatus as set forth in claim 1 wherein said means for purging said sump includes means for fluid communication between said sump and a vacuum source created in response to engine operation, said communication means being operable to effect fluid flow from said sump to the vacuum source only in response to a vacuum condition in the vacuum source.

3. Silencer apparatus as set forth in claim 2 wherein said communication means includes conduit means extending upwardly from said sump to the vacuum source.

4. Silencer apparatus as set forth in claim 3 wherein the engine includes an intake manifold, and wherein the vacuum source is the intake manifold.

5. Silencer apparatus as set forth in claim 4 wherein said conduit means includes a metering orifice for regulating the flow of fluid from said sump to the intake manifold.

6. Silencer apparatus as set forth in claim 3 wherein the internal combustion engine includes a crankcase, and wherein the vacuum source is the crankcase.

7. Silencer apparatus as set forth in claim 6 wherein said conduit means includes valve means for preventing flow from the crankcase to said sump while permitting flow from said sump to the crankcase.

8. Silencer apparatus for an internal combustion engine including an intake manifold, said apparatus comprising an air silencer communicating with the air intake manifold and having a lower end including a sump located below the intake manifold, and conduit means extending upwardly from said sump to the intake manifold and including a metering orifice for regulating the flow of fluid from said sump to the intake manifold.

9. An engine apparatus comprising an internal combustion engine including a carburetor having an air intake, an air silencer communicating with said air intake and have a lower end including a sump in which fluid can accumulate, and means extending from said sump and connected to the engine for purging fluid from said sump in response to engine operation.

10. An engine apparatus as set forth in claim 9 wherein said means for purging said sump includes means for fluid communication between said sump and a vacuum source created in response to engine operation, said communication means being operable to effect fluid flow from said sump to said vacuum source only in response to a vacuum condition in said vacuum source.

11. An engine apparatus as set forth in claim 10 wherein said communication means includes conduit means extending upwardly from said sump to said vacuum source.

12. An engine apparatus as set forth in claim 11 wherein said internal combustion engine includes an intake manifold, and wherein said vacuum source is said intake manifold.

13. An engine apparatus as set forth in claim 12 wherein said conduit means includes a metering orifice for regulating the flow of fluid from said sump to said intake manifold.

14. An engine apparatus as set forth in claim 11 wherein said internal combustion engine includes a crankcase, and wherein said vacuum source is said crankcase.

15. An engine apparatus as set forth in claim 14 wherein said conduit mens includes valve means for preventing flow from said crankcase to said sump while permitting flow from said sump to said cranckcase.

* * * * *